United States Patent [19]

Bischofberger et al.

[11] Patent Number: 4,723,651

[45] Date of Patent: Feb. 9, 1988

[54] DEVICE FOR TRANSPORTING CANS

[75] Inventors: Jurg Bischofberger, Elsau; Manfred Feige, Frauenfeld, both of Switzerland

[73] Assignee: Rieter Machine Works, Ltd., Winterthur, Switzerland

[21] Appl. No.: 904,300

[22] Filed: Sep. 5, 1986

Related U.S. Application Data

[62] Division of Ser. No. 616,403, Jun. 1, 1984.

[30] Foreign Application Priority Data

Jun. 8, 1983 [CH] Switzerland ..... 3133/83

[51] Int. Cl.[4] ..... B65G 25/02

[52] U.S. Cl. ..... 198/776; 198/774; 198/457

[58] Field of Search ..... 198/740, 774, 776, 468.6, 198/468.1, 457

[56] References Cited

U.S. PATENT DOCUMENTS

| | | | |
|---|---|---|---|
| 666,865 | 1/1901 | Helfensteller, Jr. | 198/776 |
| 2,663,330 | 12/1953 | Hill | 198/774 X |
| 2,722,406 | 11/1955 | Kurek | 198/774 X |
| 2,957,573 | 10/1960 | Eyster | 198/776 |
| 3,871,534 | 3/1975 | Bursk | 198/776 X |
| 4,069,009 | 1/1978 | Yamawaki et al. | 198/774 X |
| 4,102,450 | 7/1978 | Chapman et al. | 198/774 |
| 4,116,619 | 9/1978 | Beck | 198/774 X |
| 4,155,443 | 5/1979 | Schuricht | 198/774 |
| 4,382,503 | 5/1983 | Akita et al. | 198/774 |

FOREIGN PATENT DOCUMENTS

| | | | |
|---|---|---|---|
| 2217462 | 10/1973 | Fed. Rep. of Germany | 198/774 |

*Primary Examiner*—Robert J. Spar
*Assistant Examiner*—Lyle K. Kimms
*Attorney, Agent, or Firm*—Kenyon & Kenyon

[57] ABSTRACT

The fiber sliver can transporting device uses rails which are driven in an alternating manner to lift and roll a can along a horizontal guide plate in a step-wise manner with the can being guided by the vertical boards through a non-linear path.

2 Claims, 4 Drawing Figures

Figure 1:
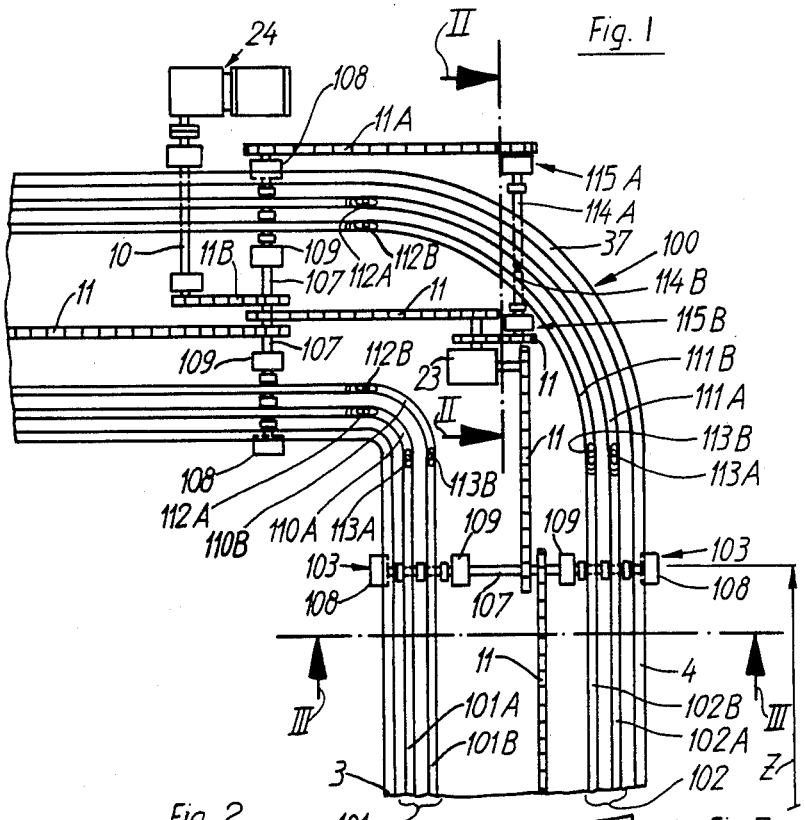

24
108
11A
II
115 A
114 A
37
100
114 B
115 B
111 B
111 A
113 B
113A
10
11B
109
107
112A
112B
11
23
112 A
110B
110A
113A
113B
103
108
107
4
102B
102A
101A
101B
3
101
102
Z
III 37
115A
115 B
114A
114B 2
3
101A
101B
S
4
102 A
108
107
106
105
104
109
102B 124
122
123
2
3
4
121
102 B
102 A

DEVICE FOR TRANSPORTING CANS

This is a division of application Ser. No. 616,403, filed Jun. 1, 1984.

The invention relates to a device for transporting cans with a horizontal can guiding system and a vertical can guiding system together with means for step-wise can feed.

Various devices have been known for transporting cans, for example as described in Swiss Patent Specification No. 389 461 (corresponding to British Patent Specification No. 941 219 and U.S. Pat. No. 3 125 782). In this device, rods provided with fingers also have Mängel-racks meshed with pinions. The fingers are secured to the rods with a spacing which is equal to the spacing of the centers of two successive cans. The rods travel through a distance which is equal to the center spacing of two cans.

The rods, and thus the fingers, are lifted during movement. Thus, the fingers move underneath the floor of the can towards the internal surface of the base of the can, so as to grasp the can forcibly and move it through the set distance. This forward stroke is terminated by the lowering and withdrawal of the fingers.

The disadvantages of this device are that only a straight transport movement is possible and that the forcible transport can lead to damage in the event of faults. Furthermore, the whole shifting mechanism is relatively expensive.

Accordingly, it is an object of the invention to provide a simple device for transporting fiber sliver cans.

It is another object of the invention to be able to transport fiber sliver cans in a damage-free manner.

It is another object of the invention to provide a relatively inexpensive sliver can transporting device.

Briefly, the invention provides a device for transporting fiber sliver cans which includes a vertical can guide system having a pair of vertical boards for guiding a can horizontally in a non-linear guide path, a horizontal guide plate between the boards to support the cans thereon and a can feed means for moving the cans in a step-wise manner along the guide plate. The can feed means includes two pairs of parallel rails which are disposed in angular relation to each other between the guide plate and one of the vertical bores. In addition, a pair of curved rails interconnect the pairs of parallel rails while means are provided for moving the rails of each pair relative to each other and through an endless path relative to the guide plate in order to alternately lift a can on the plate while rolling the can along the plate.

Furthermore the device can be advantageously used as a can magazine and as an empty can station forming part of a can magazine and a can changing device.

The advantages produced by the device are to be seen substantially in that the cans are transported in the simplest manner and such that a position correction can be carried out at any time, and further in that the transport system is usable for non-linear transport directions. Furthermore, the same device can transport in both directions simply by changing the direction of rotation as a drive motor.

In the following, the invention is explained in further detail with the aid of drawings representing merely exemplary embodiments.

Figure 2:
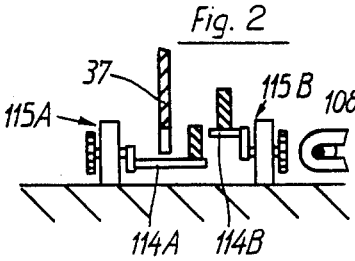
Figure 3:
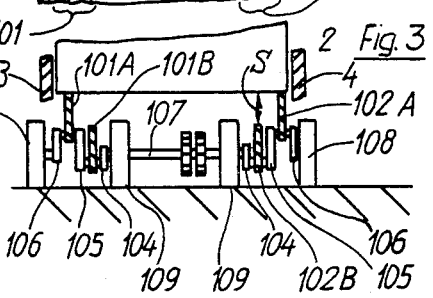
Figure 4:
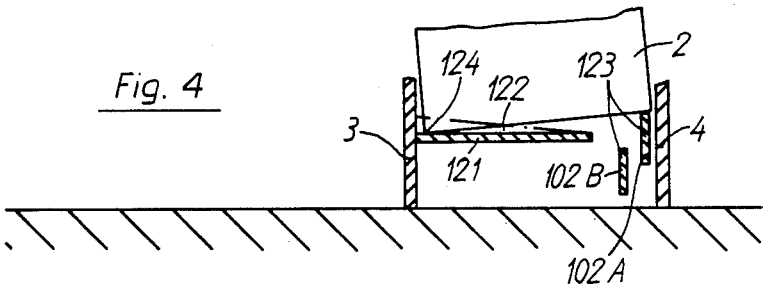

FIG. 1 shows a plan view of a device according to the invention, partly open and illustrated part-schematically, FIG. 2 shows a cross section, through a detail of the device of FIG. 1 taken on the section line II—II, FIG. 3 shows a section of the device of FIG. 1 taken on the section line III—III, FIG. 4 shows a modification of the device of FIG. 1 illustrated in section and partschematically, A device 100 for transporting of cans 2 is illustrated in the FIGS. 1 to 4 and comprises a canfeed with a pair of rails 101 with the individual rails 101A and 101B, and with a second rail pair 102 parallel thereto with the individual rails 102A and 102B, and for each rail pair 101, 102 two doublestroke crankdrives 103 (only one per rail pair being visible).

The crankdrives comprise an inner cranklever 104, a middle cranklever 105 and an outer cranklever 106 and a crankpin (not directly visible) joining these together and supporting the rails.

Further, the inner cranklever 104 is connected to a driveshaft 107 and the outer cranklever 106 is rotatably supported by means of a further crankpin in a bearing member 108. The driveshaft is also rotatably supported in the bearing members 109.

The rails 101A, 101B and 102A, 102B are provided with bearing sleeves (not shown) for receiving the crankpins.

The rails 101A, 102A are arranged between the outer cranklever 106 and the middle cranklever 105, and the rails 101B, 102B are arranged between the middle cranklever 105 and the inner cranklever 104.

Depending upon whether the transporting distance is linear or non-linear, two or more transport rail pairs are coupled together directly or, as shown in FIG. 8, by means of curved rails 110A, 110B and 111A, 111B indirectly.

The straight rails are connected by means of joint locations 112A, 112B and joint locations 113A, 113B with the above mentioned curved rails.

For each curved rail at least one joint position is provided of the adjustable joint type.

Further, as shown in FIGS. 8 and 8A, the outer curved rails 111A, 111B can be supported at their undersides (not shown) on a crankpin 114A, 114B of a crankdrive 115A, 115B respectively. The crankdrive 115B is driven in an arrangement as shown in FIG. 1 by means of a transmission chain 11 from the beveldrive 23 used for such an arrangement, while the crankdrive 115A is driven via a chain 11A including the associated chainwheels (not shown) from an extended shaft end of a driveshaft 107.

The beveldrive 23 and also the driveshaft 107 are driven by means of additional transmission chains 11. The transmission chains differ from one another substantially only in the necessarily different, appropriate length.

The chainwheels required for the transmission chains and driving the beveldrive and crankdrives have the same pitch circle diameter in all illustrated and described embodiments.

The driveshaft 10 driven from gearmotor 24 drives the adjacent driveshaft 107 by means of a transmission chain 11 and the associated chainwheels. In order to change the rotational speed of shafts 107, the chainwheels of the chain 11B can have correspondingly different numbers of teeth or pitch circle diameters.

Guide boards 3, 4 and associated bends are provided with a space for the respective outer bearing members 108 for the crankshaft 114a formed in the guideboards.

In operation, the rails 101A, 102A and the rails 101B, 102B alternately take up the cans 2 and transport them along the guideboards 3, 4 with a stroke corresponding to half of a stroke height S (FIG. 3). A floor is not required for these variants, that is the rails perform alternately the function of the horizontal can guidance.

The transport direction of the cans can be chosen corresponding to the direction of the rotation of the gearmotor 24.

The stroke height S corresponds to the double crank-radius, which for its part corresponds to the spacing between the rotation axis of the driveshaft 107 and the rotation axis of the crankpins.

Further, FIG. 4 shows a simplified embodiment of the variants illustrated in FIGS. 1 and 3, in that only the rail pair 102 is used for the feed of the cans 2 and the rail pair 101 is omitted. In place of the omitted rail pair 101, a floorplate i.e. guideplate 121 is required for supporting the cans 2. As a result of the provision of the transporting rail pair on one side only, the can 2 only rests fully on the floorplate 121 when the rails 102A and 102B take up the same height relative to floor 35. The surface 122 of the floorplate 121, and the upper rail surfaces 123 of the two transport rails 102A, 102B then lie in the same imaginary plane.

In operation, the can 2 is lifted alternately by the rails 102A, 102B respectively and is rolled by the forward movement by these rails along the guideboards 3 on the floor edge 124 of the can 2. This form of movement produces one-sided swinging deviations of the can 2 which are changed by inclined portions of the floorplate 121 (as indicated with a dotted line 125) into double-sided rocking movements each at most only half as large. The inclined portions should be optimized in such manner that the can 2 when resting on the floorplate 121 rests simultaneously on the rails 102A when the rails 102A and 102B have reached the same height.

In all illustrated variants, for each straight rail or for each straight rail pair, two crankdrives are required arranged with a spacing Z from each other. The spacing Z is shorter than the spacing between two joint positions.

We claim:

1. A device for transporting fiber sliver cans comprising a vertical can guide system having a pair of vertical boards for guiding a can horizontally therebetween in a non-linear guide path; and a horizontal guide plate between said boards to support a can thereon; and a can feed means for moving the can in a stepwise manner along said guide plate while causing the can to rotate in said guide path, said can feed means including two pairs of parallel rails disposed in angular relation to each other between said guide plate and one of said boards, a pair of curved rails interconnecting said pairs of parallel rails and means for moving said rails of each pair relative to each other and through an endless path relative to said guide plate to alternately lift and support one side of a can while the opposite side of the can remains supported on the plate to cause the can to rotate and to move along said path.

2. A device as set forth in claim 1 wherein said rails of each pair are movable into a common plane with said guide plate.

* * * * *

UNITED STATES PATENT AND TRADEMARK OFFICE

CERTIFICATE OF CORRECTION

PATENT NO. : 4,723,651

DATED : February 9, 1988

INVENTOR(S) : JURG BISCHOFBERGER, et al

It is certified that error appears in the above-identified patent and that said Letters Patent is hereby corrected as shown below:

Column 1, line 65 "as" should be -of-

Signed and Sealed this

Twenty-third Day of August, 1988

*Attest:*

DONALD J. QUIGG

*Attesting Officer*

*Commissioner of Patents and Trademarks*